US008005417B2

(12) United States Patent
Hattori et al.

(10) Patent No.: US 8,005,417 B2
(45) Date of Patent: Aug. 23, 2011

(54) BOOKBINDING SYSTEM WITH AN ADHESIVE REPLENISHING RATE CONTROLLER

(75) Inventors: Masato Hattori, Hino (JP); Masaki Matsui, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 468 days.

(21) Appl. No.: 11/714,230

(22) Filed: Mar. 6, 2007

(65) Prior Publication Data

US 2008/0056848 A1 Mar. 6, 2008

(30) Foreign Application Priority Data

Aug. 30, 2006 (JP) ..... 2006-233325

(51) Int. Cl.
*G03G 15/14* (2006.01)

(52) U.S. Cl. ..... 399/408; 399/407; 412/6; 412/8

(58) Field of Classification Search ..... 399/408, 399/407; 412/6, 8
See application file for complete search history.

(56) References Cited

U.S. PATENT DOCUMENTS 6,964,707 B2 * 11/2005 Taniguchi et al. ..... 118/244
7,346,309 B2 * 3/2008 Nakamura et al. ..... 399/408
7,448,837 B2 * 11/2008 Oota ..... 412/37
7,783,245 B2 * 8/2010 Nakamichi et al. ..... 399/408

FOREIGN PATENT DOCUMENTS

JP 2004 / 209753 A 7/2004
JP 2004 / 209869 A 7/2004

OTHER PUBLICATIONS

Patent Office of the People's Republic of China, Notification of the First Office Action, Dec. 4, 2009.

* cited by examiner

*Primary Examiner* — Matthew G Marini
(74) *Attorney, Agent, or Firm* — Finnegan, Henderson, Farabow, Garrett & Dunner, L.L.P.

(57) ABSTRACT

A bookbinding system comprising: an image forming apparatus; and a bookbinding apparatus; wherein both the image forming apparatus and the bookbinding apparatus include a communication section respectively, for transmitting information from the image forming apparatus to the bookbinding apparatus; the bookbinding apparatus comprises a coating section for coating adhesive on a stack of sheets, a replenishing section for replenishing adhesive to the coating section, and a controller for controlling the replenishing section; and the controller controls replenishment rate of the adhesive by the replenishing section, based on information transmitted from the image forming apparatus through the communication section.

7 Claims, 9 Drawing Sheets

BOOKBINDING SYSTEM WITH AN ADHESIVE REPLENISHING RATE CONTROLLER

CROSS REFERENCE TO RELATED APPLICATIONS

The present application is based on Japanese Patent Application No. 2006-233325 filed in Japan on Aug. 30, 2006, the entire contents of which are incorporated herein by reference.

BACKGROUND OF THE INVENTION

1. Technical Field of the Invention

The present invention relates to a bookbinding system for producing a booklet wherein an image forming apparatus is connected with a bookbinding apparatus, and all the production operations from printing to bookbinding are performed in one process.

2. Description of Related Art

There has been widespread use of a bookbinding system wherein a high-speed image forming apparatus such as an electrophotographic image forming apparatus is connected with a bookbinding apparatus, and all the production operations from image formation to bookbinding are performed in one process.

As compared to the conventional general bookbinding process wherein the printing process is separated from the bookbinding process, such a bookbinding system is characterized in that the contents of printing can be changed as desired, although the printing speed and bookbinding speed are lower. This bookbinding system is evaluated as a high-efficiency bookbinding system in a comprehensive manner, and has been used as a POD (Print On Demand) system.

In the POD system, the image forming apparatus is connected with the bookbinding apparatus. Further, the POD system is often placed in an office or the same building as the office, not in a factory specifically designed for printing and bookbinding. This requires a compact configuration of the system as well as the components constituting the system.

Thus, a preferably used bookbinding apparatus produces a booklet by binding sheets using a comparatively simple process of gluing.

A hot melt adhesive is used as an adhesive. In response to consumption in coating, replenishing adhesive pellets little by little ensures continuous bookbinding operation. The Patent Documents 1 and 2 disclose a replenishing apparatus wherein the coating roller is moved along the spine of the stack of sheets to apply adhesive to the stack of sheets, and a small and constant amount of adhesive pellet (several pieces at a time) is supplied into a molten adhesive tank wherein a coating roller is immersed.

[Patent Document 1] Unexamined Japanese Patent Application Publication No. 2004-209746

[Patent Document 2] Unexamined Japanese Patent Application Publication No. 2004-276457

In a coating mechanism wherein a coating section made up of a coating roller and coating solution tank is moved along the spine of a stack of sheets and adhesive coating is provided, the tank capacity will be limited due to the limited capacity of the coating section. This will result in a sharp reduction of the liquid level in the tank due to the reduction in the liquid volume consumed in coating. To ensure uniform coating, means must be provided to reduce the shift of the liquid level in the vertical direction. In Patent Document 1, when there is a reduction in the amount of adhesive, a predetermined number of pellets are supplied, whereby the liquid level of adhesive is kept at a constant level. However, according to the method of supplying adhesive in the Patent Document 1, there is a shift in the adhesive liquid level in the vertical direction, which makes it difficult to ensure uniform coating. This is due to the following reasons:

FIG. 1 will be used for this explanation:

The liquid level LS of the molten adhesive is detected using an adhesive volume sensor TS for detecting the temperature. As shown in FIG. 1 (*a*) and FIG. 1 (*b*) or FIG. 1 (*c*), the adhesive volume sensor TS is detached from the liquid level LS by the reduction in the liquid level LS. In this case, the temperature detected by the adhesive volume sensor TS is reduced, and reduction in the liquid level LS is detected.

The following procedure is used to detect the liquid level LS: When the adhesive tank BT has a small capacity, the percentage of the amount of adhesive to be sucked up by the coating roller RL for is large as compared to the amount of adhesive in the adhesive tank BT. This causes a greater fluctuation of the liquid level LS. If there is a difference in the thickness among the stacks of sheets to be coated, a change in the status from FIG. 1 (*a*) to FIG. 1 (*b*) occurs in one coating process, or a change occurs in the status of FIG. 1 (*c*).

As illustrated, when the coating roller turns in the arrow direction, adhesive liquid level LS is higher on the downstream side in the rotating direction of the coating roller RL due to the viscosity of liquid. However, the liquid level is stable on the downstream side, and detection on the downstream side provides accurate information on the amount of adhesive in the adhesive tank BT.

The adhesive volume sensor TS merely detects a change in the status from FIG. 1 (*a*) to FIG. 1 (*b*), and a change in the status from FIG. 1 (*a*) to FIG. 1 (*c*). It is not sufficient to distinguish between the status of FIG. 1 (*b*) and that of FIG. 1 (*c*). To be more specific, the adhesive volume sensor TS is responsible for on/off detection alone, and is incapable of detecting a reduction in the liquid level. Thus, when adhesive is replenished using the detection signal by the sensor TS of FIG. 1, a shift of the adhesive liquid level occurs in the vertical direction due to the difference in the rate of consumption of adhesive. This causes difficulties in uniform coating. If a plurality of sensors are used, multi-phased detection of the liquid level may be possible, but a problem will be raised in costs and sensor installation space. More serious problems will occur when the detection accuracy is to be enhanced.

SUMMARY OF THE INVENTION

According to one aspect of the present invention, there is provided A bookbinding system comprising: an image forming apparatus; and a bookbinding apparatus; wherein both the image forming apparatus and the bookbinding apparatus include a communication section respectively, for transmitting information from the image forming apparatus to the bookbinding apparatus; the bookbinding apparatus comprises a coating section for coating adhesive on a stack of sheets, a replenishing section for replenishing adhesive to the coating section, and a controller for controlling the replenishing section; and the controller controls replenishment rate of the adhesive by the replenishing section, based on information transmitted from the image forming apparatus through the communication section.

DETAILED DESCRIPTION OF THE PREFERRED EMBODIMENT

Figure 2:
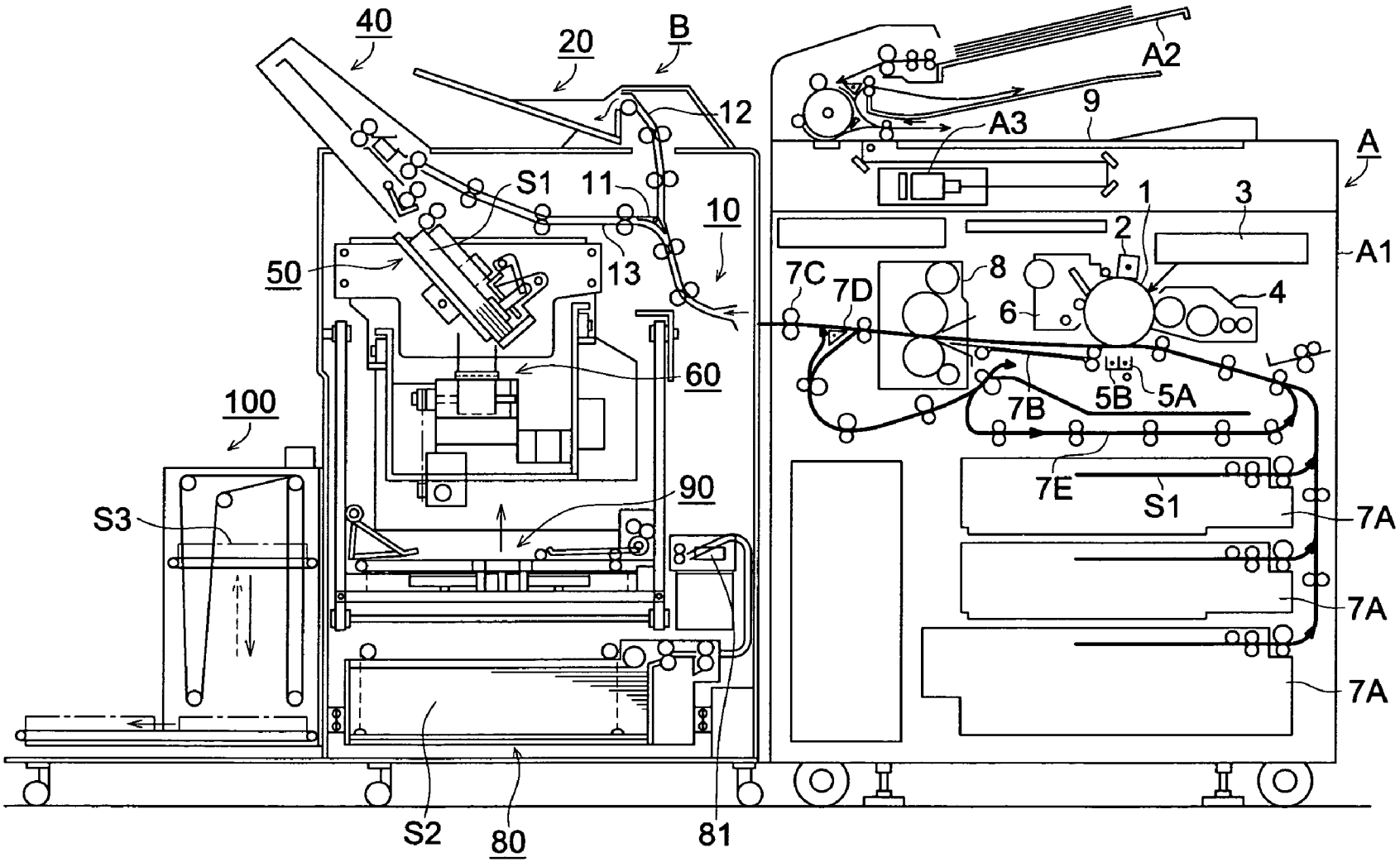
FIG. 2 is a general view of a bookbinding system containing a bookbinding apparatus as an embodiment of the present invention.

With reference to FIG. 2, the following provides the general description of the bookbinding system as an embodiment of the present invention.

The bookbinding system includes an image forming apparatus A and bookbinding apparatus B.

The image forming apparatus A forms an image on a sheet according to the electrophotographic method and is provided with an image forming section A1, a document conveyance apparatus A2 and an image reading section A3.

In the image forming section A1, a charging apparatus 2, exposure apparatus 3, development apparatus 4, transfer apparatus 5A, separation apparatus 5B and cleaning apparatus 6 are arranged around the drum-shaped photoreceptor 1. Processes of charging, exposure, development and transfer are applied by these electrophotographic process apparatuses, and a toner image is formed on the photoreceptor 1, and an image is formed on the sheets S1.

The sheets S1 are accommodated in three sheet feed trays 7A. They are fed one by one from these sheet feed trays 7A and a toner image is transferred to sheets S1 on the photoreceptor 1 by the transfer apparatus 5A.

The toner image transferred on the sheets S1 pass through the fixing apparatus 8, and is fixed. The fixed sheets S1 are ejected from a sheet ejection roller 7C or is conveyed to a sheet re-feed path 7E.

A switching gate 7D switches the sheets S1 to guide them in the face-down sheet ejection in single-sided printing, face-up sheet ejection in single-sided printing, or surface image formation in double-sided image formation. To be more specific, in the face-up sheet ejection, the switching gate 7D causes straight traveling of sheets S1. In the formation of face-down sheet ejection and double-sided image, the switching gate 7D guides the sheets S1 downward.

In face-down sheet ejection, the sheets S1 are guided downward and are switched back. They are then conveyed upward and are ejected from the sheet ejection roller 7C.

In the formation of a double-sided image, sheets S1 are guided downward and are reversed by switching back. Then the sheets S1 pass through the sheet re-feed path 7E, and are re-fed to the transfer section provided with the transfer apparatus 5A. Then the image on the rear face is transferred.

The document conveyance apparatus A2 feeds documents one by one to the reading position. The image reading section A3 reads the image from the documents conveyed by the document conveyance apparatus A2, or the documents mounted on the document platen 9, whereby an image signal is generated.

In the bookbinding apparatus B, a plurality of the sheets of the present arrangement fed from the image forming apparatus A are formed in a bundle as a stack of sheets of the present arrangement. This stack of sheets is bonded with a front cover sheet and is made into a booklet. In the following description, sheets of this arrangement will be called sheets S1, and the front cover sheet will be called a front cover S2. The sheets of the present arrangement bonded with a front cover sheet will be referred to as a booklet S3.

The bookbinding apparatus B includes:

a sheet conveyance section 10 for ensuring ensures that the sheets S1 ejected from the image forming apparatus A is conveyed to the sheet ejection tray 20 or sheet reversing section 40;

a sheet ejection tray 20;

a sheet reversing section 40;

a stacking section 50 for stacking the sheets S1 one by one or several sheets S1 having been fed as one unit;

a coating section 60;

a front cover storage section 80 for storing front covers S2;

a front cover support section 90 for supporting the front cover; and an ejection section 100.

The sheets S1 ejected from the image forming apparatus A are ejected to the sheet ejection tray 20 through an ejection path 12 by the switching gate 11 provided on the sheet conveyance section 10 or are fed to the sheet reversing section 40. When the system is not in the bookbinding mode, sheets S1 are ejected to the sheet ejection tray 20.

In the bookbinding mode, the sheets S1 are fed to the sheet reversing section 40 through the sheet conveyance path 13. After having been switched backed by the sheet reversing section 40, the sheets are conveyed to the stacking section 50. A predetermined number of sheets S1 are stacked by the stacking section 50. When a predetermined number of sheets S1 have been stacked, the stacking section 50 rotates and holds the bundle of sheets S1 almost in the perpendicular position.

The coating section 60 coats adhesive on the lower surface of the bundle of sheets S1 held by the stacking section 50 in the perpendicular position.

The front cover S2 comes in contact with the bundle of sheets S1 coated with adhesive and is bonded thereto.

The booklet S3 produced from the sheets S1 bonded with the front cover S2 is ejected to the ejection section 100.

Figure 3:
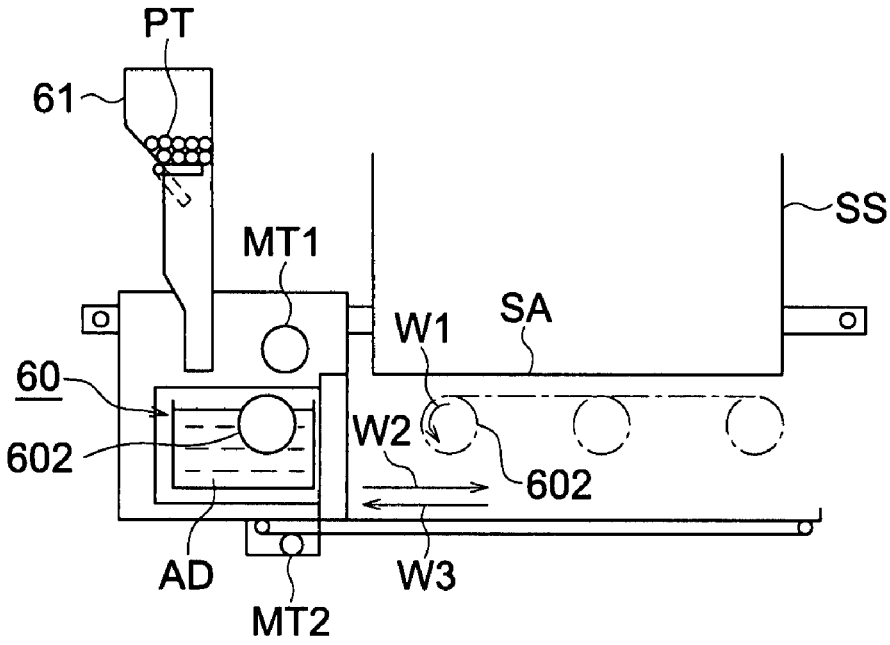
FIG. 3 is a drawing showing an adhesive coating process.

The following describes the coating process with reference to FIG. 3:

The coating section 60 is located below the bundle of the sheets S1. During the movement by a motor MT1 in the outward direction indicated by arrow W2, the coating roller 602 applies adhesive AD to the spine SA of the stack of sheets SS. During the movement in the homeward direction indicated by arrow W3, the coating roller 602 applies adhesive AD to the spine SA.

Figure 1:
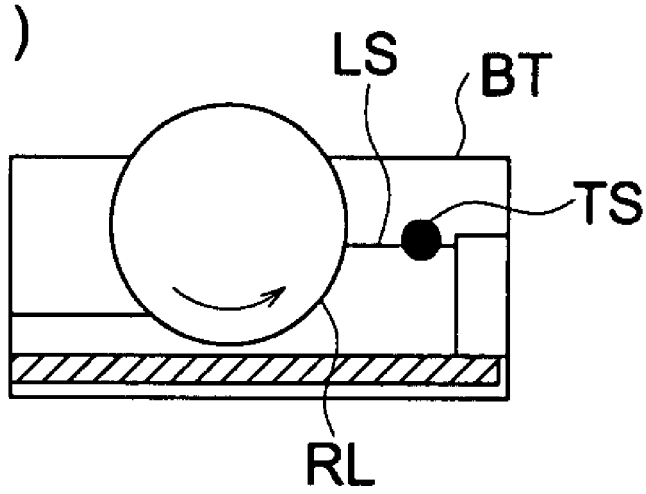
FIG. 1 (*a*), FIG. 1 (*b*) and FIG. 1(*c*) are drawings representing how the amount of adhesive is detected by detection of a reduction in liquid level.
Figure 1:
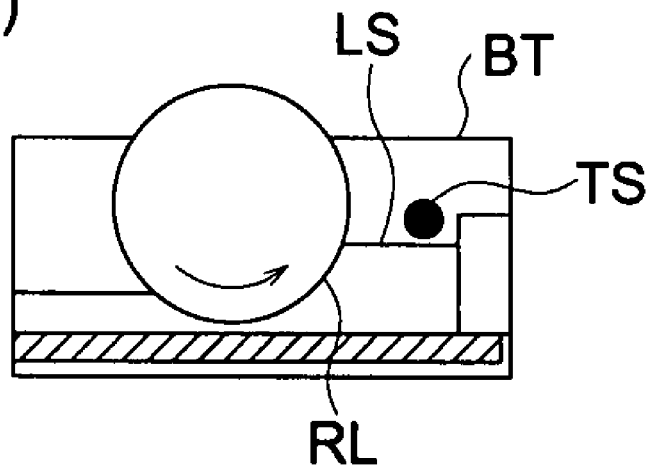
Figure 1:
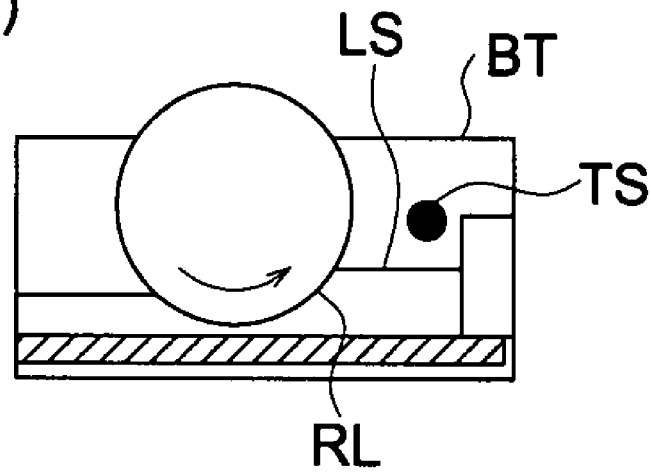

The home position of the coating section 60 is on the left end of FIG. 3. It is located at the furthest position as viewed from the front surface of the bookbinding apparatus of FIG. 1. Adhesive pellets are supplied to this home position from the replenishing apparatus 61. The coating roller 602 is rotated by the motor MT2 in the direction of arrow W1 during the outward and homeward traveling. It sucks up the adhesive from the adhesive tank 601, and applies it to the spine SA of the stack of sheets SS.

Figure 4:
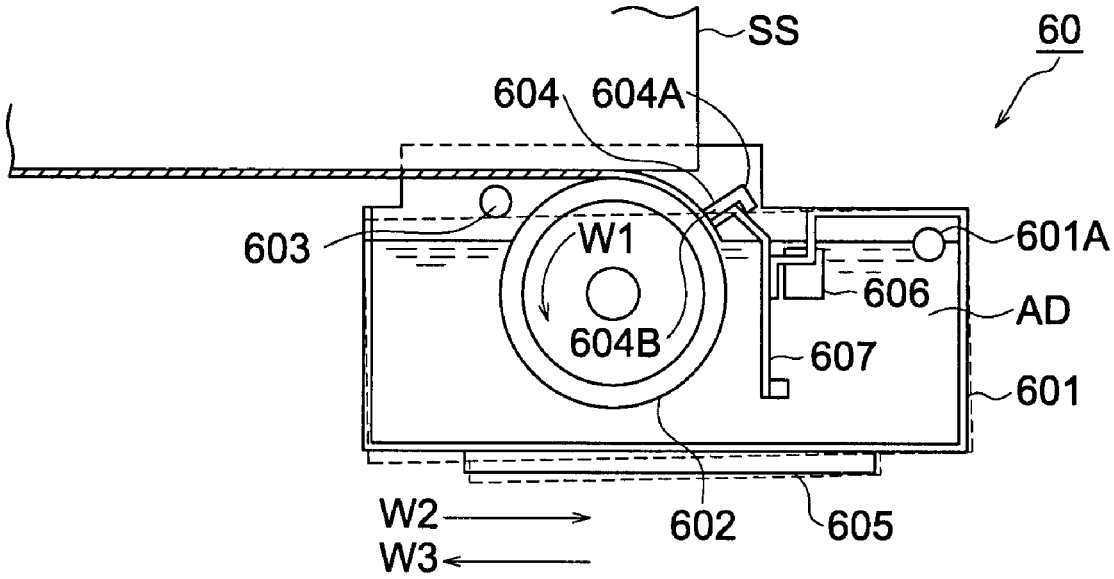
FIG. 4 is a drawing showing the arrangement of a coating section 60.

Referring to FIG. 4, the following describes the structure of the coating section 60:

The coating section 60 is provided with an adhesive tank 601 for accommodating adhesive AD, coating roller 602, regulating members 603 and 604, heater 605 and adhesive volume sensor 606.

The pellet in the adhesive tank 601 is heated and melted by the heater 605 so that a coating solution of adhesive AD is formed. The amount of adhesive AD is detected by an adhesive volume sensor 606 made up of a temperature sensor, and the liquid level is kept constant. The regulating member 604 is supported by a plate-formed support member 607, and its lower edge 604B regulates the thickness of the adhesive layer on the coating roller 602. Its upper edge 604A regulates the thickness of adhesive layer on the spine SA of the stack of sheets.

The adhesive tank 601 is set by rotating about shaft 601A from the standby status shown by a dotted line to the coating status shown by a solid line. The adhesive volume sensor 606 has a temperature detection element made up of a thermister. When the adhesive volume sensor 606 is immersed in the liquid of adhesive AD, the detection temperature is high and the liquid level is lowered. When the adhesive volume sensor 606 is detached from the liquid level, the detection temperature reduces. When this temperature reduction has been detected, the amount of adhesive is below the specified level.

If the detection signal for the reduction in the amount of adhesive is issued, adhesive is replenished from the replenishing apparatus 61.

The following describes the replenishing apparatus 61 for replenishing adhesive pellets with reference to FIG. 5 through FIG. 8.

Figure 5:
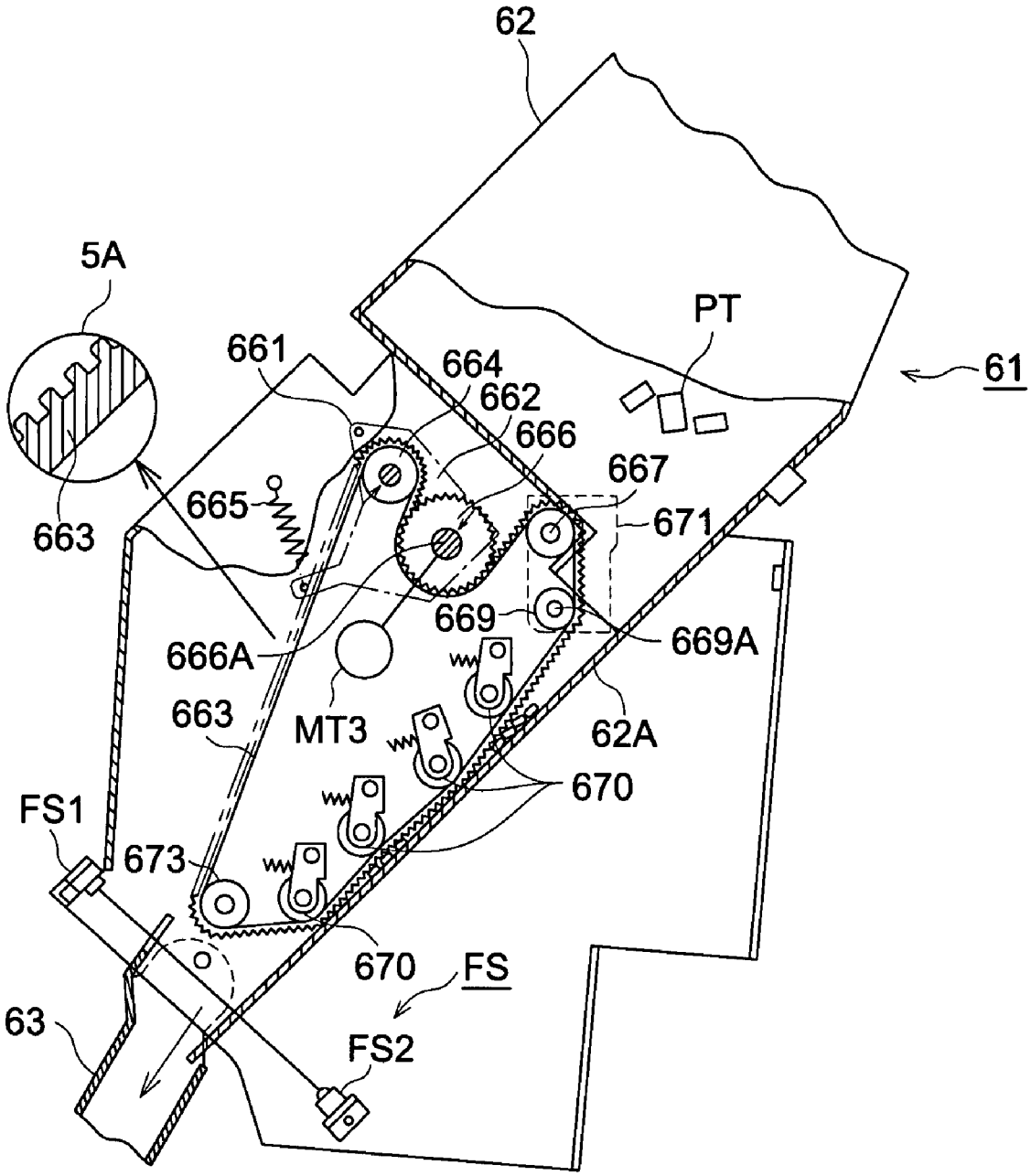
FIG. 5 is a cross sectional view showing a replenishing apparatus 61.
Figure 6:
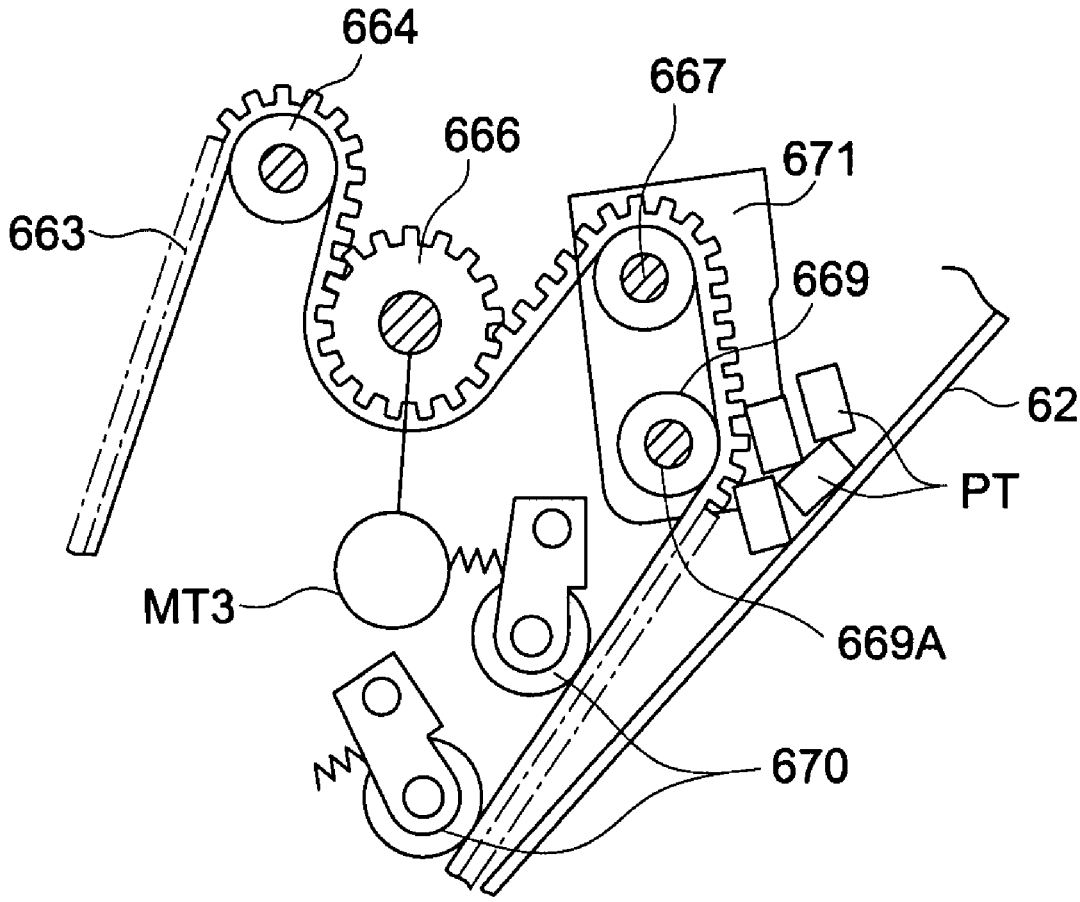
FIG. 6 is a drawing showing the major components of the replenishing apparatus 61 prior to starting the operation.
Figure 7:
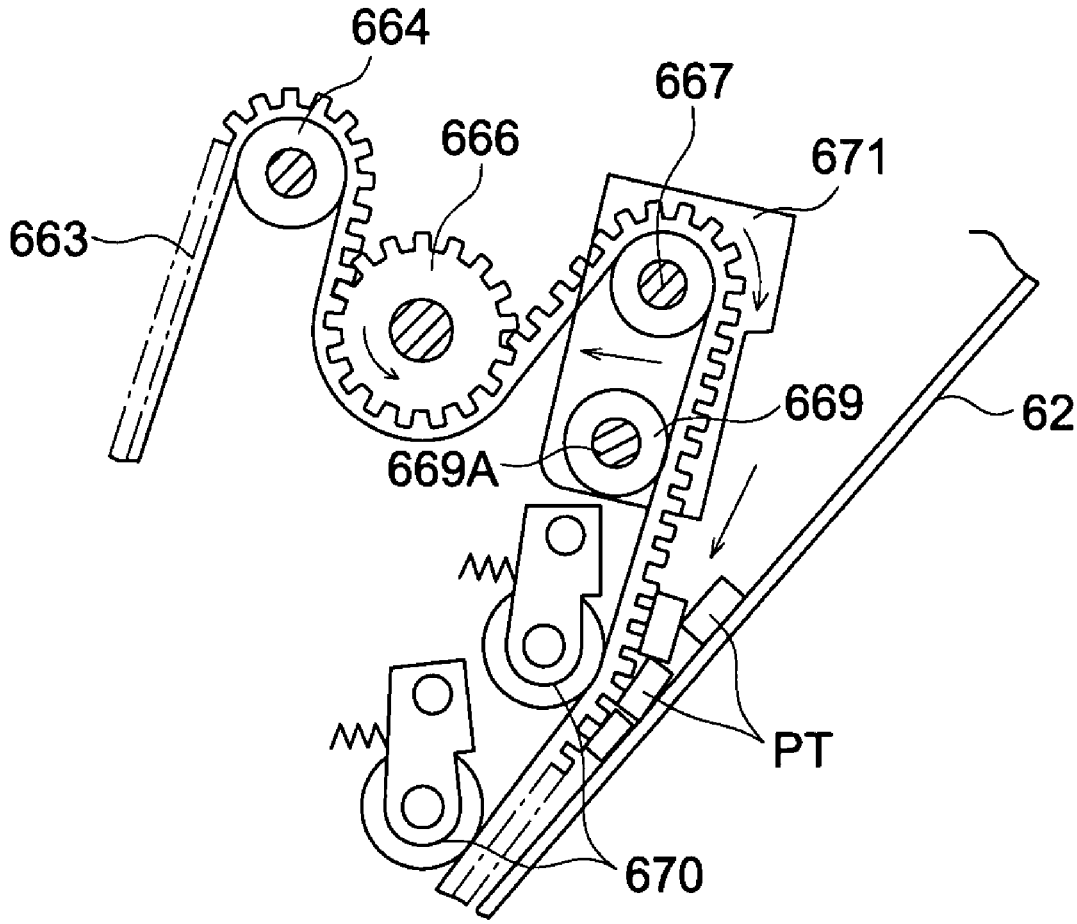
FIG. 7 is a drawing showing the major components of the replenishing apparatus 61 during the process of replenishment.
Figure 8:
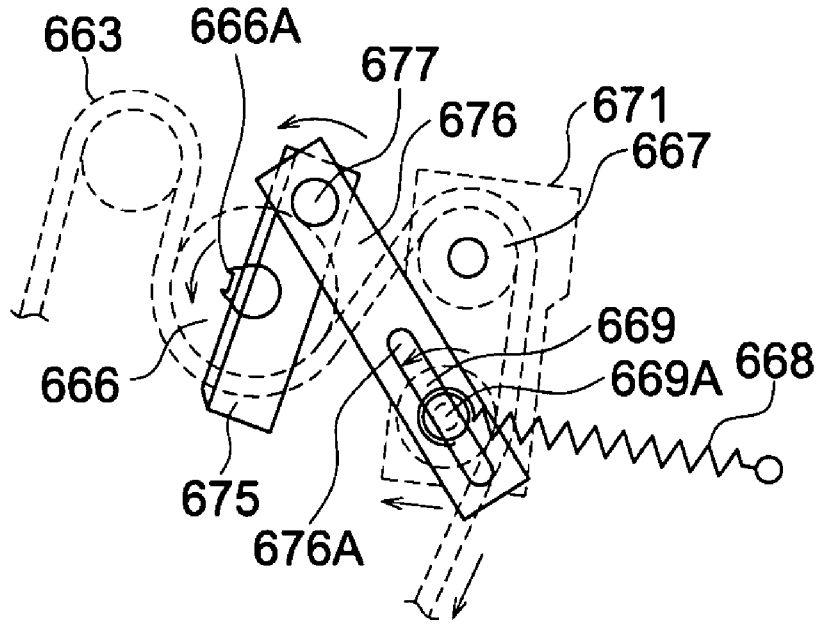
FIG. 8 is a drawing showing the drive system of the replenishing apparatus.
Figure 8:
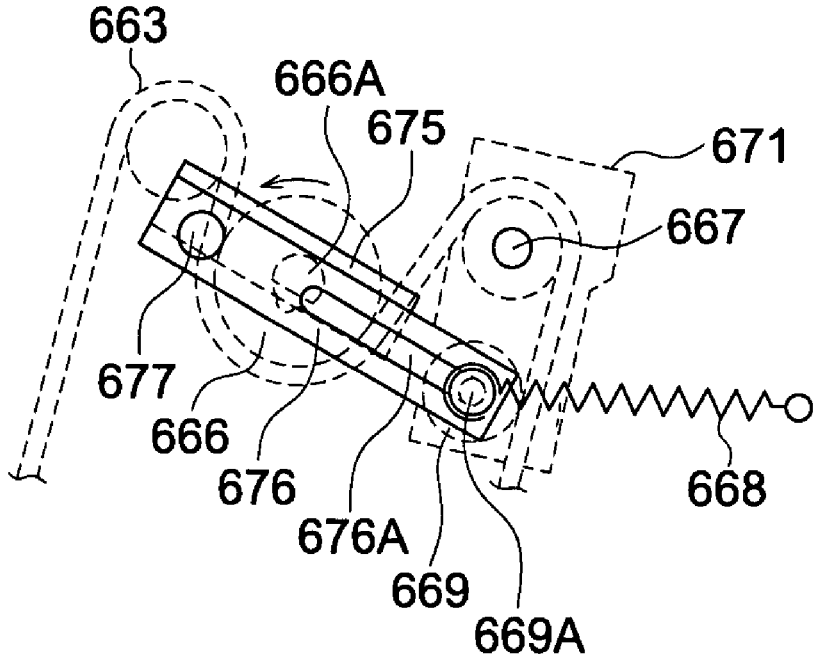

FIG. 5 is a cross sectional view showing a replenishing apparatus 61. FIG. 6 shows the major components of the replenishing apparatus 61 prior to starting the operation. FIG. 7 shows the major components of the replenishing apparatus 61 during the process of replenishment. FIG. 8 shows the drive system of the replenishing apparatus 61.

The replenishing apparatus 61 includes a hopper 62 as a pellet storage section for storing the adhesive pellet PT, and a supply tube 63 for dropping the pellet PT. The frame 62A constituting the hopper 62 supports the components illustrated below.

The replenishing apparatus 61 is incorporated in the bookbinding apparatus B in the state shown in FIG. 5, namely, when the hopper 62 and supply tube 63 are inclined downward to the left. The pellet PT falls along the bottom surface of the frame 62A and the bottom surface of the supply tube 63, and is supplied to the coating section 60.

A belt 663 for conveying the pellet PT is applied to the rollers 664, 666, 667, 669 and 673 below the lower portion of the hopper 62. The roller 666 is a drive roller and is driven by the motor MT3 constituting the supply section to rotate in the counterclockwise direction.

As shown in the enlarged FIG. 5A, a roughened structure is formed on the outer peripheral surface of the belt 663 constituting the supply section. This roughened surface ensures reliable conveyance of the pellet PT and reduces the area in contact with the pellet PT, thereby preventing the pellet PT from coming in contact with the belt 663. Four pressure rollers 670 allows the belt 663 to be pressed against the frame 62A by the force of a spring so that the distance between the frame 62A and belt 663 will not increase in excess of a predetermined limit. Thus, control is provided to ensure that the rate of the pellet PT conveyed by the belt 663 is kept at an almost constant level.

The rollers 664 and 666 are supported by the support plate 662 that can be rocked about the shaft 666A of the roller 666. The support plate 662 is energized by the tension spring 665 in the clockwise direction. Thus, a predetermined tension is applied to the belt 663 by the roller 664 energized by the spring 665.

The rollers 667 and 669 are supported by the support plate 671 that can rock about the rotary shaft of the roller 667.

When stopped before the start of operation, the replenishing apparatus 61 is as shown in FIG. 6.

The roller 669, and the pellet PT ejection port is made narrow. The pellet PT is blocked by the belt 663 supported by the roller 669, as shown in FIG. 6, and remains in the hopper 62.

When the replenishing apparatus 61 has started the operation, the roller 669 moves to the left, as shown in FIG. 7, and the paddle 663 goes backward so that the pellet ejection port of the hopper 62 is widened. This allows the pellet PT to fall down to the ejection port, and the pellet PT having fallen continues to fall along the bottom surface of the frame 62A due to the conveying force of the belt 663.

While the replenishing apparatus 61 is engaged in the operation of replenishment, the roller 669 performs a back-and-forth motion between the position shown in FIG. 6 and the position of FIG. 7. This back-and-forth motion causes the pellet PT to fall little by little at a controlled rate, and is supplied to the coating section 60.

Referring to FIG. 8, the following describes the drive mechanism for back-and-forth motion of the roller 669.

The support plate 675 rotating integrally with the roller 666 is fixed on the shaft 666A of the roller 666. A link 676 is rotatably supported by the pin 677 provided on one end of the support plate 675.

The shaft 669A of the roller 669 is inserted into the slot 676A provided on the link 676.

The shaft 669A of the roller 669 is energized by the tension spring 668, and is pressed against the right of FIG. 8. Thus, the roller 669 is held at a predetermined position by the tension of the belt 663 and the energy of the spring 668.

The support plate 675 is rotated by the rotation of the roller 666. The right end position of the link 676 is moved by the rotation of the support plate 675 in the lateral direction in FIG. 7. This movement allows the position of the roller 669 to be shifted in the lateral direction. Thus, the pellet ejection port of the hopper 62 is made narrow or wide, as shown in FIG. 6 and FIG. 7.

This operation of narrowing or widening the port is repeated during the process of replenishment. The pellets PT are supplied little by little to the coating section 60 at a controlled rate.

Going back to FIG. 5, the FS denotes a replenishing sensor for detecting the pellet PT falling from the hopper 62 and is made up of a light emitting element FS1 and a light receiving element FS2. The replenishing sensor FS detects the number of pellets PT supplied to the coating section 60. The count of the pellets PT by the replenishing sensor FS is proportional to the number of the pellets PT to be supplied.

Figure 9:
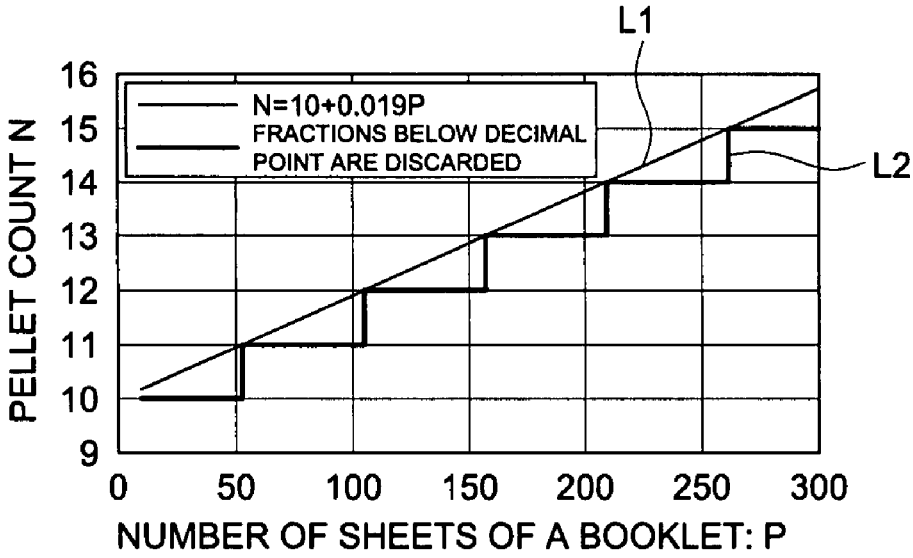
FIG. 9 is a drawing showing the replenishment rate for appropriate adhesion on the number of the sheets S1 constituting the stack of sheets SS.

As described above, reduction in the liquid level of adhesive AD is detected, and the pellet PT of adhesive is replenished in response to the detection signal. The replenishment rate of the pellet PT will be described with reference to FIG. 9. FIG. 9 shows the replenishment rate of the pellet PT for appropriate adhesion on the number of sheets S1 constituting the stack of sheets SS.

In FIG. 9, the horizontal axis indicates the number P of sheets S1 constituting the stack of sheets SS, and the vertical axis denotes the count N by the replenishing sensor FS of the pellets PT to be replenished. It shows the result obtained from coating tests using the coating section of FIG. 4.

In FIG. 9, the horizontal axis indicates the number of sheets. Theoretically, it indicates the amount of adhesive consumed by coating. The amount of adhesive consumed corresponds to the thickness and size of the stack of sheets SS determined mainly by the number of sheets and the thickness of one sheet. Further, the amount of consumption also differs according to the type of sheets such as coated paper and non-coated paper.

Straight line L1 is expressed by the following formula 1:

$$\text{Appropriate rate } N=10+0.019P \qquad \text{Formula 1}$$

It should be noted that the count by the replenishing sensor FS is not always equal to the number of pellets to be replenished. In the test example, one count by the replenishing sensor FS corresponds to an average of 2.5 pellets.

In the actual control, as indicated by the polygonal line L2, the number of pellets wherein fractions below decimal point are discarded is used to indicate the appropriate number of pellets to be replenished. The adhesive volume sensor 606 (shown in FIG. 4) receives the signal for the detection of reduction in the liquid level, and the count corresponding to the amount of replenishment in response to the number of sheets is determined by calculation according to the formula 1. The replenishment of pellets is started, and the appropriate value of FIG. 9 is reached. At this moment, the controller (to be described later) stops replenishment.

The liquid level LS of adhesive is kept at an almost constant level by the aforementioned control, and uniform coating is carried out.

Figure 10:
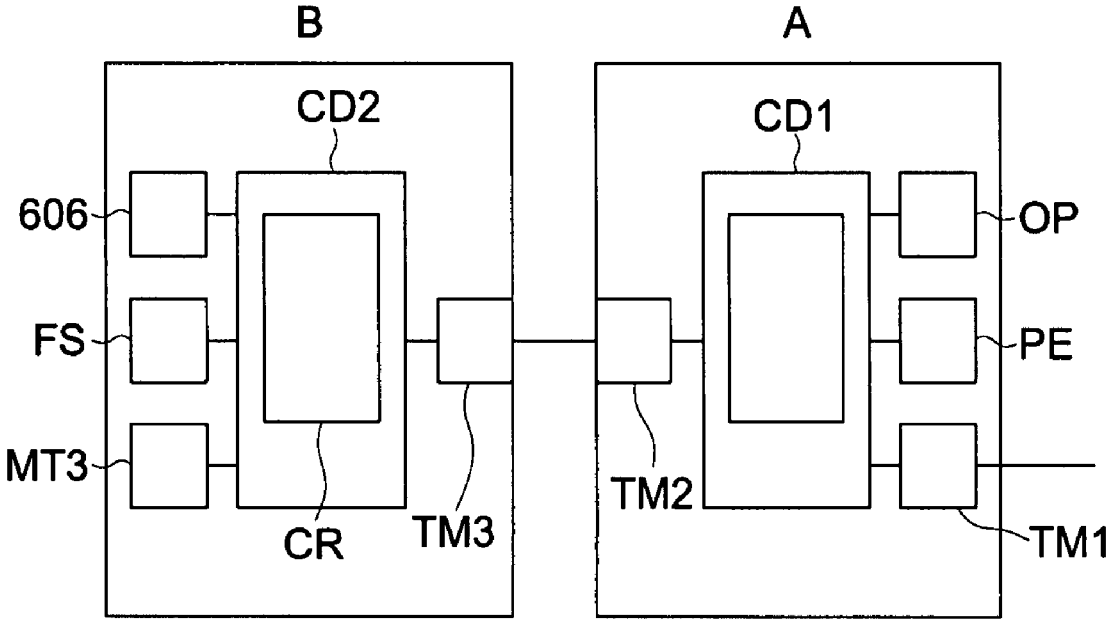
FIG. 10 is a block diagram representing the control system.
Figure 11:
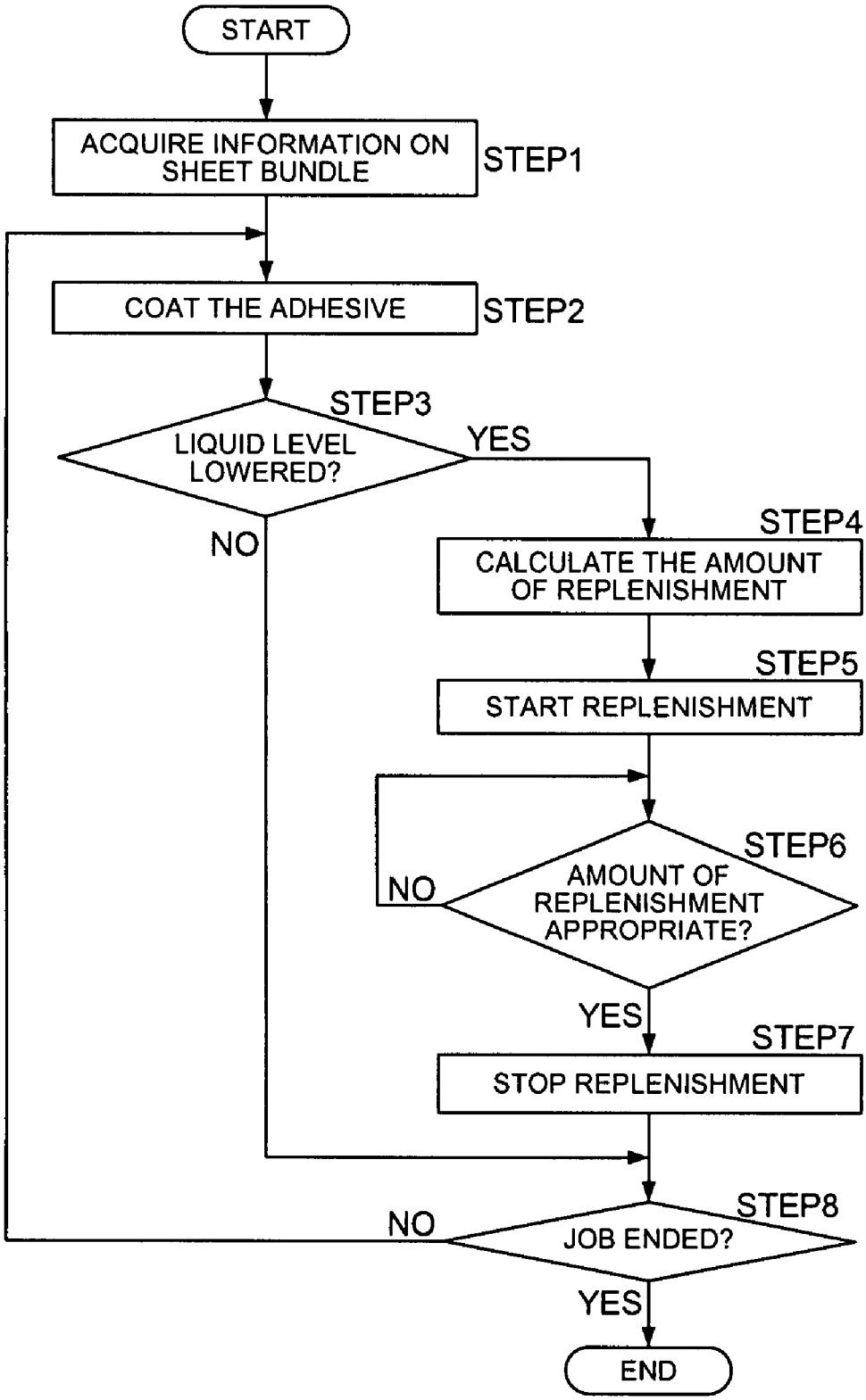
FIG. 11 is a flowchart of coating control.

FIG. 10 is a block diagram representing the control system for controlling replenishment of adhesive. FIG. 11 is a flowchart of coating control.

In FIG. 10, the image forming apparatus A includes:

an image forming apparatus controller CD1 for controlling the image forming apparatus A and the entire bookbinding system;

an operation section OP;

a communication section TM1 for communication with external equipment through the network; and a communication section TM2 for communication with the image forming section PE and bookbinding apparatus B.

The bookbinding apparatus B includes:

a bookbinding apparatus controller CD2 for controlling the bookbinding apparatus B;

an adhesive volume sensor 606;

a replenishing sensor FS for detecting the replenishment of adhesive;

a motor MT3 as a drive source of the supply section for replenishment of pellets; and a communication section TM3 for communication with the image forming apparatus A.

The bookbinding apparatus controller CD2 has a controller CR that controls replenishment of pellets shown in FIG. 11.

In response to the job instruction from the operation section OP or external equipment, an image is formed on the sheet by in the image forming section PE. The sheet with an image formed thereon is fed to the bookbinding apparatus B, and a process of bookbinding is performed in the bookbinding apparatus B.

In the bookbinding apparatus B, the adhesive consumed by bookbinding is replenished to the coating section, whereby a continuous process of bookbinding is carried out.

In the Step 1 of FIG. 11, the information on the stack of sheets to be coated with adhesive is acquired by the controller CR from the image forming apparatus controller CD1 through the communication section TM2 and TM3. The information on the stack of sheets includes information on the number of sheets constituting the booklet, the thickness of the sheet, the type of sheets showing the difference in coated paper and non-coated paper, and the size of paper.

In Step 2, the coating section 60 performs a back-and-forth motion and the adhesive is coated on the spine of the stack of sheets.

In Step 3, when the coating section 60 has gone back to the home position subsequent to the process of coating in Step 2, reduction in the liquid level of adhesive is detected. If the reduction is not detected (N in Step 3), the process terminates. If the reduction is detected (Y in Step 3), the appropriate amount of coating is calculated (Step 4).

The calculation in Step 4 is carried out, for example, according to the polygonal line L2 of FIG. 9 according to the lookup table stored in the storage section of the controller CR.

In Step 5, the replenishment of pellets starts.

In Step 6, the output from the replenishing sensor FS is monitored. When the count of the replenishing sensor FS has reached the appropriate level (Y in Step 6), replenishment stops (Step 7).

If the preset number of booklets has been produced and the bookbinding job has completed, the system terminates the current operation (Y in Step 8). If not, the system goes back to Step 2 (N in Step 8).

In FIG. 10 and FIG. 11, the controller CR acquires the information on stack of sheets, and the amount of pellet to be replenished is determined according to the acquired information. As described above, the information on stack of sheets contains information on the number, thickness, type and size of sheets. Further, the operator can directly set the replenishment rate, in addition to using the function of automatic replenishment wherein the information required to calculate the replenishment rate is calculated by the controller CR from such information.

It is also possible to use the following arrangements:

For example, the replenishment rate is provided in several levels, and the operator selects and sets the appropriate replenishment rate from the thickness of the stack of sheets or such factors. The settings by the operator are inputted into the controller. CR as information on the stack of sheets.

In the automatic replenishment control, the controller CR acquires the information on the number, thickness and size of sheets from the image forming apparatus A, and calculates the appropriate the replenishment rate. It is also possible to use the following arrangements: The sheet stacking section 50 is provided with a sheet thickness sensor for detecting the thickness of the stack of sheets SS of FIG. 2. In response to the detection signal of the sheet thickness sensor, the controller CR calculates the appropriate replenishment rate. In this case, the controller CR gets information on the size and type of the sheet from the image forming apparatus A. Such information is added to calculate the replenishment rate, whereby more accurate calculation of the replenishment rate can be ensured.

Further, the replenishment rate based on the aforementioned formula 1 can be determined by the image forming apparatus controller CD1 or bookbinding apparatus controller CD2. In the structure wherein the replenishment rate is determined in the image forming apparatus controller CD1, the controller CR controls the replenishment based on the information on the replenishment rate transmitted from the image forming apparatus. In the structure wherein the replenishment rate is determined in the bookbinding apparatus controller CD2, the controller CR controls the replenishment by determining the replenishment rate based on the information of the stack of sheets transmitted from the image forming apparatus.

In the present invention, the appropriate amount of adhesive is supplied according to the information on the stack of sheets constituting a booklet, and uniform coating of adhesive is provided at all times in a compact coating section as well. Thus, the present invention provides a bookbinding apparatus capable of producing a high-quality booklet characterized by a high degree of bonding strength.

What is claimed is:

1. A bookbinding system comprising:

an image forming apparatus for forming images in response to a job instruction; and a bookbinding apparatus adapted to make a booklet by bonding a stack of sheets with a front cover sheet;

wherein both the image forming apparatus and the bookbinding apparatus include a communication section respectively, for transmitting information from the image forming apparatus to the bookbinding apparatus;

the bookbinding apparatus comprises a coating section for coating adhesive on the stack of sheets, a replenishing section for replenishing adhesive to the coating section, and a controller for controlling the replenishing section;

wherein the coating section is provided with an adhesive tank and a sensor to detect an amount of adhesive in the adhesive tank;

wherein when the sensor detects a reduction of the adhesive in the adhesive tank after a coating process by the coating section, the bookbinding apparatus controls the replenishing section to replenish adhesive to the adhesive tank once in a current job according to the job instruction; and wherein the controller controls the replenishment rate of the adhesive by the replenishing section, based on information which represents at least a number of sheets constituting a booklet, a thickness of the sheets, a type of the sheets, and a size of the sheets and is transmitted from the image forming apparatus through the communication section.

2. The bookbinding system of claim 1, wherein the information transmitted through the communication section includes information of number of sheets included in the stack of sheets.

3. The bookbinding apparatus of claim 1, wherein the information transmitted through the communication section comprises at least one piece of information of a thickness of a sheet in the stack of sheets, a type of the sheet and a size of the sheet.

4. The bookbinding apparatus of claim 1, wherein the adhesive replenished to the coating section is solid and is in pellet form, and the bookbinding apparatus further comprising a replenishment sensor to detect an amount of pellets to be replenished by the replenishing section, wherein the controller controls the replenishing section based on a signal from the replenishment sensor.

5. The bookbinding apparatus of claim 1, further comprising a stack of sheets sensor to detect a thickness of the stack of sheets, and the stack of sheets sensor outputs the information of the stack of sheets.

6. The bookbinding apparatus of claim 1, further comprising a bookbinding apparatus controlling section, wherein the bookbinding apparatus controlling section determines the replenishing rate based on the information of the stack of sheets transmitted from the image forming apparatus.

7. The bookbinding apparatus of claim 1, further comprising an image forming apparatus controlling section, wherein the image forming apparatus controlling section determines the replenishment rate based on the information of the stack of sheets transmitted from the image forming apparatus.

* * * * *